United States Patent [19]

Shimizu et al.

[11] Patent Number: 4,657,198

[45] Date of Patent: Apr. 14, 1987

[54] APPARATUS FOR MEASURING THE THICKNESS OF A ROLL WINDING ON OR UNWINDING FROM A CORE

[75] Inventors: Shigehisa Shimizu; Takao Otokozawa, both of Kanagawa, Japan

[73] Assignee: Fuji Photo Film Co., Ltd., Kanagawa, Japan

[21] Appl. No.: 735,647

[22] Filed: May 20, 1985

[30] Foreign Application Priority Data

May 18, 1984 [JP] Japan ..... 59-98641

[51] Int. Cl.[4] ..... B41J 29/48; B65H 26/08; G01V 9/04

[52] U.S. Cl. ..... 242/57; 250/571

[58] Field of Search ..... 242/57, 67.5, 75.45; 33/132 A, 136, 550; 250/571

[56] References Cited

U.S. PATENT DOCUMENTS

| | | | |
|---|---|---|---|
| 2,825,513 | 3/1958 | Yerrid et al. | 242/57 |
| 3,161,365 | 12/1964 | Johnson et al. | 242/57 |
| 3,279,716 | 10/1966 | Huck | 242/57 X |
| 3,971,956 | 7/1976 | Jakeman et al. | 250/571 |

FOREIGN PATENT DOCUMENTS

| | | | |
|---|---|---|---|
| 47-13292 | 4/1972 | Japan . | |
| 51-31257 | 3/1976 | Japan . | |
| 202246 | 11/1983 | Japan | 242/57 |
| 207244 | 12/1983 | Japan | 242/57 |
| 76317 | 4/1985 | Japan | 242/57 |

*Primary Examiner*—Stuart S. Levy
*Assistant Examiner*—Joseph J. Hail, III
*Attorney, Agent, or Firm*—Young & Thompson

[57] ABSTRACT

An apparatus for measuring the thickness of a roll winding on or unwinding from a core during winding or unwinding of a web, comprises a first detector having a beam projector and a beam receiver which are arranged along the core at opposite ends of the roll for detecting a predetermined thickness of the roll with a rough accuracy. A second detector having a beam projector and a linear array sensor is provided, for detecting the roll thickness with high accuracy. When the first detector detects a predetermined thickness of the roll, the second detector, which is supported on an arm carrying a positioning roller, is placed in operative position by pressing the positioning roller against the core and detects the thickness of the roll according to the position on the linear array sensor of the beam reflected from the surface of the roll.

8 Claims, 4 Drawing Figures

APPARATUS FOR MEASURING THE THICKNESS OF A ROLL WINDING ON OR UNWINDING FROM A CORE

BACKGROUND OF THE INVENTION

This invention relates to apparatus for measuring the thickness of a roll of web material such as photographic film, paper, textile or the like, winding on or unwinding from a core.

In winding/unwinding apparatus for winding a web onto a core and unwinding it therefrom, it is necessary, when winding, to make the total thickness of the wound roll uniform for providing wound rolls of uniform quality, and when unwinding webs while splicing them end to end by using an automatic splicer, to ensure that the ends left on the core will be as short as possible for economy. Therefore, such machines are provided with apparatus for measuring, say, the remaining thickness of a roll unwinding from a core, which controls a driving mechanism so as gradually to reduce the unwinding speed when it detects a remaining thickness of unwinding roll approaching a predetermined one, and to stop upon detecting the predetermined thickness.

For example, Japanese Patent Publ. 47-13292 discloses such apparatus as mentioned above, whereby the transport speed of a web unwinding from a master roll is measured. At the time when a predetermined transport speed of web is detected, the apparatus controls a driving mechanism to begin the reduction of its driving rate. During the reduction, the apparatus calculates the desired instantaneous transport speed of the web from the target remaining thickness of the unwinding roll, the present remaining thickness of unwinding roll, the reduction ratio of the driving rate and the thickness of the web, and controls the driving mechanism so as to make the transport speed of the web follow the desired transport speed thus calculated, in order that final thickness will accurately match the target thickness (i.e. the final remaining thickness of the roll on the core). Generally speaking, because the transport speed often fluctuates, an error in measuring the remaining thickness of the roll on a core can result from such fluctuation.

There has been proposed an apparatus independent of fluctuations in the transport speed of the web, which is disclosed in, for example, Japanese Patent Unexamined Publ. 51-31257. In such apparatus, there are provided pulse signals for every unit of transferred length of the web and for every fractional revolution of the core on which the web is rolled. Continuously changing diameter of wound web is detected by counting the pulses corresponding to the transferred length of web per unit fraction of a revolution of the core.

Both devices mentioned above have serious disadvantages, one being that noticeable error appears easily in the measurement of the thickness of the web due to the fact that the core is subject to eccentric rotation because the core and the chucks rotatably supporting it at both ends are not coaxial and/or the core is eccentric itself.

OBJECTS OF THE INVENTION

It is therefore an object of the present invention to provide an apparatus for measuring the thickness of a roll winding on or unwinding from a core, in which the measurement of the thickness is independent of any eccentric rotation of the core on which the web is wound.

It is another object of the present invention to provide an apparatus for measuring the thickness of a roll winding on or unwinding from a core, in which the measurement of the thickness is independent of the transport speed of the web and of any fluctuations in such transport speed.

SUMMARY OF THE INVENTION

To accomplish the above-mentioned objects, the present invention provides a first and a second detector, the first being for detecting a predetermined thickness of roll winding on or unwinding from the core with a low accuracy and the second detector, which comprises means for projecting a spot-like beam onto the surface of the roll and means for receiving the reflected beam therefrom, for detecting a continuously changing thickness of roll winding on or unwinding from the core with a high accuracy. The second detector, which is combined with a positioning roller, is placed in position by pressing the positioning roller against the surface of the core in response to a signal emitted when the first detector detects the predetermined thickness of roll winding on or unwinding from the core and then estimates the distance between the surfaces of the core and of the outermost convolution of web by optical triangulation.

According to the present invention, the second detector is maintained at a fixed distance from the surface of the core by pressing the positioning roller against the core, thereby forcing it to follow any eccentric movement of the core, thereby ensuring the measurement of the thickness of roll winding on or unwinding from the core with high accuracy by triangulation. The provision of such a positioning roller makes the second detector independent of any eccentric rotation owing to the core and the chucks not being coaxial and/or the core itself being eccentric. Furthermore, the measurement of the thickness of roll winding on or unwinding from the core with the second detector is also independent of the transport speed of web and hence independent of any fluctuation or irregularity of that speed.

Further according to the present invention, the provision of a second detector, in addition to the first detector for rough measurement, permits the second detector to have a narrow range of measurement, resulting in the measurement of the final thickness of the roll with high accuracy.

Still further according to the present invention, the diameter of the roll is obtained by adding the known diameter of the core to twice the thickness of the roll wound on the core.

BRIEF DESCRIPTION OF THE DRAWINGS

These and other features and advantages of the present invention will be described in more detail in the following, by way of an example, reference being had to the accompanying drawings, in which.

DETAILED DESCRIPTION OF THE INVENTION

Figure 1:
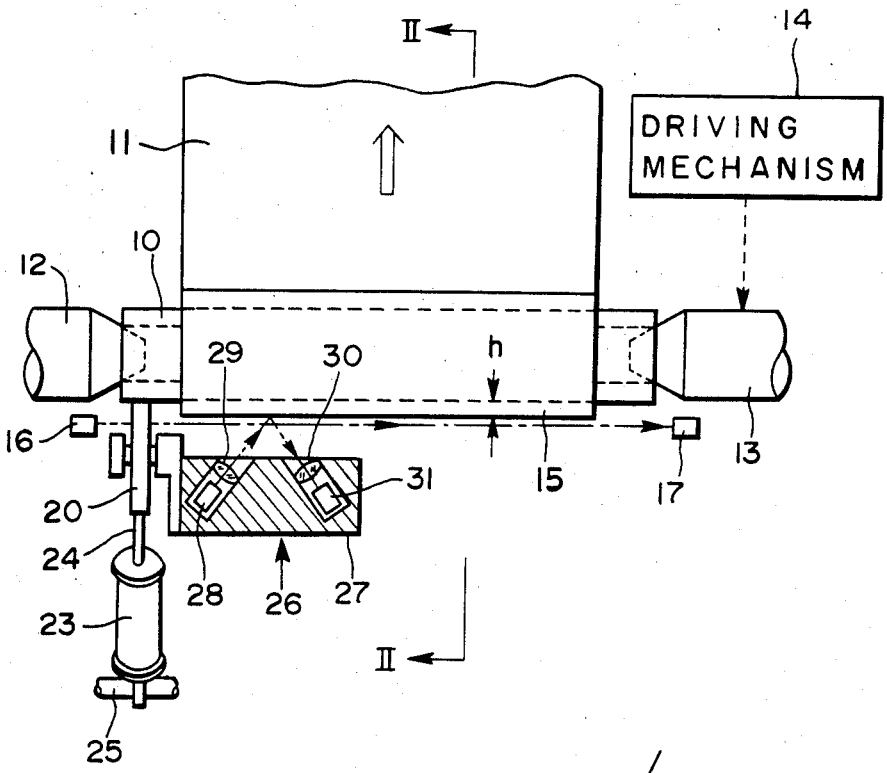
FIG. 1 is a plan view of an unwinding apparatus to which the present invention is applied.
Figure 2:
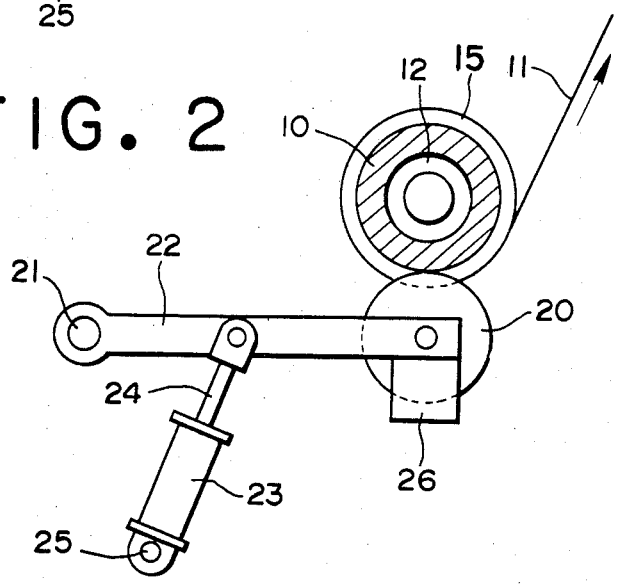
FIG. 2 is a cross sectional view taken along the line II—II of FIG. 1.

Referring to FIGS. 1 and 2 of the drawings, there is shown an unwinding apparatus to which the present invention is applied and which includes a hollow core 10 around which a web 11 is wound. The core 10 is removably supported at opposite ends by a pair of rotatable chucks 12, 13 having a shape such as a frustum of a cone, one being driven by a driving mechanism 14 comprising a motor and a reduction gear to unwind the web 11 and feed it toward a work station through a transport system (not shown).

A first detector system 35, which comprises a spot beam projector 16 and a beam receiver 17 arranged at opposite ends of the roll, detects roughly a predetermined remaining thickness of the unwinding roll 15, as a result of the beam falling upon the beam receiver 17. It should be noted that the first detector system 35, which is provided for making a rough measurement of the remaining thickness of the roll 15, may be replaced by a conventional detection apparatus, such as is mentioned above.

As shown in FIG. 2 in detail, arranged near one end of the core 10 is a positioning roller 20 which is brought into contact with the outer surface of the core 10 by pivoting an arm 22 counterclockwise about a pivot 21. For causing the pivotal movement of the arm 22, the arm 22 is pivotally connected intermediate its length with a piston rod 24 of an air cylinder 23 which is pivotally mounted at its other end on a shaft 25. Alternatively, for bringing the positioning roller 20 into contact with the surface of the core 10, other devices may be used.

Fixed to the free end of the arm 22 is a second detector 26 which includes in its housing 27 a light source 28, condensing lenses 29, 30 and a sensor array 31. The light source 28 projects a spot beam, which is focused on the surface of the unwinding roll 15 as a spot through the lens 29 and is reflected thereby. The reflected beam is directed toward and is focussed on the sensor array 31 by the lens 30. The sensor array 31 detects the remaining thickness of the unwinding roll 15 from the point of incidence. It should be noted that, when photosensitive materials such as photographic film web are used, a semiconductor laser source can be used to project an infrared beam so as to avoid sensitization. In addition, it is desirable to make the size of the beam spot as small as possible.

Figure 3:
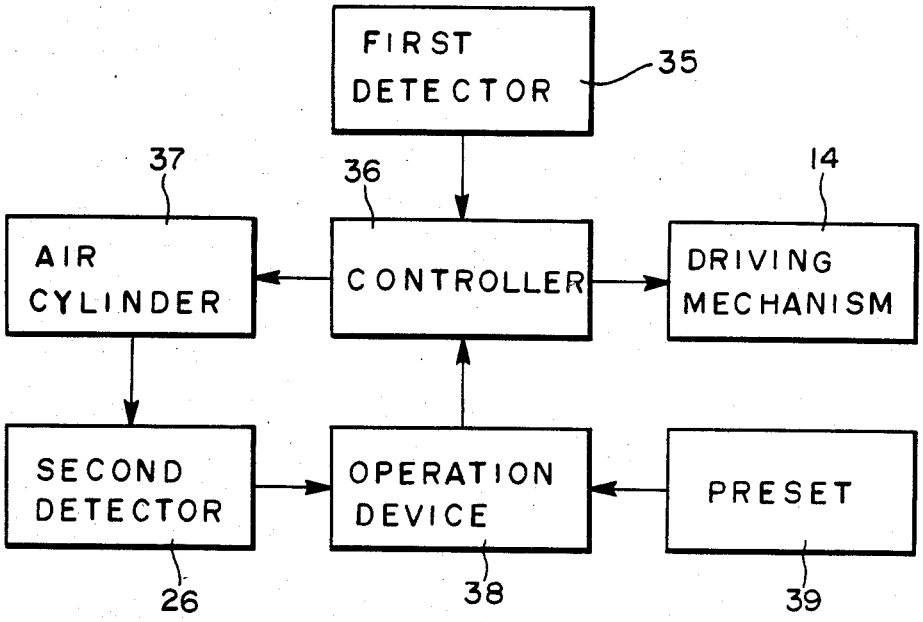
FIG. 3 is a block diagram showing a control circuit according to the present invention.

Referring now to FIG. 3, shown therein, in block diagram form, is a control circuit for the unwinding apparatus shown in FIG. 1. The first detector 35, when detecting a predetermined remaining thickness of the unwinding roll 15, provides a signal which in turn is directed toward a controller 36 and actuates it to cause the actuation of the air cylinder 37 in the counterclockwise direction as seen in FIG. 3. When the positioning roller 20 is pressed against the spool 10, the air cylinder 37 provides a setting signal which in turn is directed toward the second detector 26 and starts it measuring the remaining thickness of the unwinding roll 15. The second detector 26, which is maintained at a fixed distance from the surface of the core 10 by the contact of the positioning roller 20 with the core 10, provides a distance signal representing the distance between the core 10 and the outer surface of the unwinding roll 15 and applies it to an operation device 38 for calculating the remaining thickness of the unwinding roll 15. Simultaneously, the operation device 38 provides a speed reduction signal or a stop signal by comparing the calculated thickness with the thickness preset in a setting device 39. In accordance with the reduction signal or stop signal from the operation device 38, the controller 36 controls the driving mechanism 14 to reduce its rotational speed.

Figure 4:
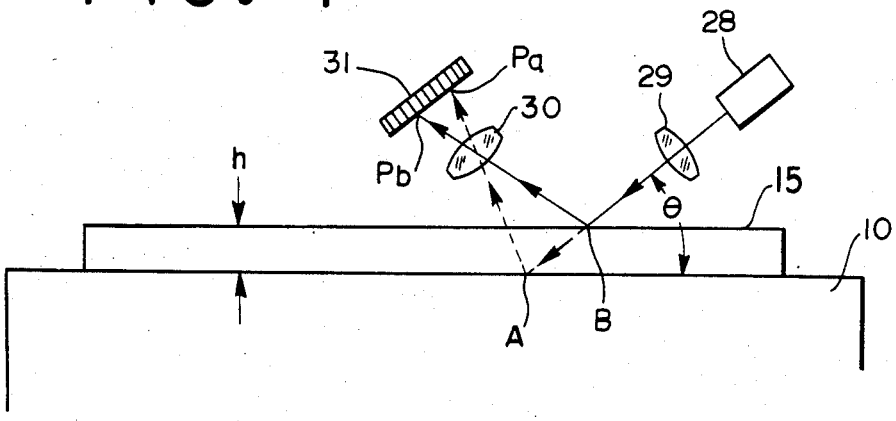
FIG. 4 diagrammatically illustrates the operation of the second detector.

The operation of a desired embodiment of the apparatus for measuring the remaining thickness of a roll unwinding from a core according to the present invention is described hereinafter with reference to FIG. 4.

When the driving mechanism 14 is actuated, the core 10 is caused to rotate in a direction such as to unwind the web 11 and feed it to a work station through a transport system. During the unwinding operation, the first detector 35 causes the air cylinder 23 to operate upon detecting that the remaining thickness of the unwinding roll 15 is almost equal to a predetermined remaining thickness, so as to swing the arm 22 and press the positioning roller 20 against the outer surface of the core 10. The rotatable positioning roller 20 keeps the second detector 26 at a fixed distance from the surface of the core 10 even though the core 10 may rotate eccentrically. The spot beam projected from the light source 28, after being reflected by the web 11, is focused on the sensor array 31 having a plurality of pixels arranged in a line. More specifically, the reflected beam from the web 11 is focused on one of a plurality of pixels corresponding to an angle of incidence each of which provides a corresponding signal different from the others and applies it to the operation device 38 in order to calculate the remaining thickness (h) of the unwinding roll 15 by using the following equation:

$$h=(Nb-Na)\times P\times \sin\theta/m$$

wherein

Na: the location of pixel Pa on which the reflected beam from the web is focused;

Nb: the location of the pixel Pb on which the reflected beam from the core is focused;

$\theta$: the angle of projection;

m: the magnification of the lens 30;

P: the pitch of the pixel array.

The thickness h thus obtained is then compared with the thickness at the beginning of speed reduction and at the end, both of which values are preset in the setting device 39 so as to provide a speed reduction signal which in turn is applied to the controller 36. The controller 36 provides an instruction signal corresponding to the speed reduction signal, to the driving mechanism 14 and controls the operation thereof so as gradually to reduce the rotational speed of the core 10 in response to the reduction of the remaining thickness of the unwinding roll 15, and stop the rotation of the core 10 when a predetermined remaining thickness of the unwinding roll 15 is reached. Meanwhile, the instruction signal is simultaneously applied to the transport system so as to slow it down.

The accuracy of the thickness measurement is explained hereinafter by a specific example. Assuming that the core 10 has a diameter of 200 mm, the remaining thickness of unwinding roll 15 is 0.1 mm and the core 10 is supported with chucks with an eccentricity of 0.8 mm, an error equivalent to eight convolutions of the web 11 or about five meters of the web 11 will arise due to this eccentricity. Therefore, roughly five meters of the web 11 will wastefully remain. But by using the web roll apparatus for measuring the remaining thickness of the roll on a core according to the present invention, because of the positioning roller 20 pressed against the core 10, the second detector 26 is independent of any eccentricity due to the core 10 and/or chucks 12, 13. As a result, the web 11 is unwound reliably without leaving any substantial length of web 11 unused.

The present invention is, of course, equally applicable to winding apparatus for winding a web around a core.

Although the invention has been described in detail with particular reference to a preferred embodiment thereof, it will be apparent to those skilled in the art that the invention is not limited to this embodiment but that variations and modifications may be made without departing from the scope of the invention.

What is claimed is:

1. An apparatus for measuring the thickness of a roll on a core, said apparatus comprising:

a positioning roller movable between a position in which said positioning roller contacts a said core and a position spaced from a said core;

a first detector for detecting a predetermined thickness of said roll and providing a first signal;

means for pressing said positioning roller against the surface of said core when said first signal is provided; and a second detector for detecting the thickness of said roll, said second detector comprising means for projecting a beam toward the surface of said roll and means for receiving a reflected beam from said surface of said roll and adapted to provide a second signal corresponding to the thickness of said roll according to the position of said reflected beam on said beam receiving means.

2. An apparatus as defined in claim 1, wherein said first detector comprises a projector for projecting a beam parallel to said core and a receiver for receiving said beam, said projector and receiver being disposed at opposite ends of said roll.

3. An apparatus as defined in claim 1, wherein said second detector includes a linear array sensor having a plurality of pixels arranged in line.

4. An apparatus as defined in claim 3, wherein said second detector includes a semiconductor laser source for emitting an infrared beam.

5. An apparatus as defined in claim 1, wherein said positioning roller pressing means comprises an arm rotatably holding said positioning roller and an air cylinder for causing the rotation of said arm to press said positioning roller against said core.

6. An apparatus as defined in claim 5, wherein said second detector is fixed to said arm.

7. An apparatus as defined in claim 1, further comprising a driving mechanism for rotating said core, said driving mechanism being controlled in response to the application of said second signal thereto to reduce the rotational speed of said core.

8. An apparatus as defined in claim 7, in which said driving mechanism begins to reduce the rotational speed of said roll at the time of the detection of said predetermined thickness and stops said core when a target thickness is detected.

* * * * *